US008790142B2

(12) United States Patent
Nehm et al.

(10) Patent No.: US 8,790,142 B2
(45) Date of Patent: Jul. 29, 2014

(54) PLUG-TYPE CONNECTOR

(75) Inventors: Detlef Nehm, Schieder-Schwalenberg (DE); Thomas Führer, Blomberg (DE); Hans-Hilmar Schulte, Schieder-Schwalenberg (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 0 days.

(21) Appl. No.: 13/609,929

(22) Filed: Sep. 11, 2012

(65) Prior Publication Data

US 2013/0065410 A1 Mar. 14, 2013

Related U.S. Application Data

(63) Continuation of application No. PCT/EP2011/053753, filed on Mar. 11, 2011.

(30) Foreign Application Priority Data

Mar. 12, 2010 (DE) ..... 10 2010 011 371

(51) Int. Cl.
*H01R 13/41* (2006.01)

(52) U.S. Cl.
USPC ..... 439/733.1

(58) Field of Classification Search
USPC ..... 439/733.1, 246
See application file for complete search history.

(56) References Cited

U.S. PATENT DOCUMENTS 3,295,097 A * 12/1966 Horssen et al. ..... 439/746
3,573,720 A * 4/1971 Reynolds ..... 439/697
4,274,701 A * 6/1981 Bannert et al. ..... 439/748
4,351,582 A 9/1982 Emerson et al.
4,548,461 A * 10/1985 John et al. ..... 439/733.1
4,772,229 A * 9/1988 Nix et al. ..... 439/733.1
4,778,404 A * 10/1988 Pass ..... 439/387
4,865,558 A * 9/1989 Stoner ..... 439/246
4,966,557 A * 10/1990 Barkus et al. ..... 439/246
5,060,372 A * 10/1991 Capp et al. ..... 29/883
5,256,073 A * 10/1993 Reymond et al. ..... 439/79
5,419,723 A * 5/1995 Villiers et al. ..... 439/843
5,980,328 A * 11/1999 Takanashi et al. ..... 439/733.1
6,000,972 A * 12/1999 Abe ..... 439/733.1
6,254,412 B1 * 7/2001 Muta et al. ..... 439/246
6,338,638 B2 * 1/2002 Kodama ..... 439/246
6,527,571 B2 * 3/2003 Muta et al. ..... 439/246
7,503,786 B2 * 3/2009 Kato et al. ..... 439/239
2002/0197898 A1 * 12/2002 Kim ..... 439/246
2010/0173531 A1 7/2010 Holste
2010/0279556 A1 * 11/2010 Zweigle ..... 439/733.1
2011/0014822 A1 * 1/2011 Kato et al. ..... 439/733.1
2011/0073364 A1 3/2011 Reibke
2011/0256782 A1 * 10/2011 Tung et al. ..... 439/733.1

FOREIGN PATENT DOCUMENTS

DE 2713894 10/1978
DE 27 13 894 B2 6/1980

(Continued)

*Primary Examiner* — Gary Paumen
(74) *Attorney, Agent, or Firm* — Woodard, Emhardt, Moriarty, McNett & Henry LLP

(57) ABSTRACT

The subject matter of the invention is a plug-type connector, comprising a contact carrier element (10), wherein a contact element (16) for receiving a conductor (12) of a cable is arranged in the contact carrier element (10), wherein the contact element (16) is fixed in the contact carrier element (10), wherein, in the event of a force being exerted on the contact element (16) which is greater than the holding force of the fixing, the fixing can be released and the contact element (16) becomes movably mounted in the contact carrier element (10).

5 Claims, 2 Drawing Sheets

(56) References Cited

FOREIGN PATENT DOCUMENTS

| | | |
|---|---|---|
| DE | 200 04 053 U1 | 5/2000 |
| DE | 202 06 391 U1 | 10/2002 |
| DE | 102 55 190 | 6/2004 |
| DE | 10 2006 014646 | 10/2007 |
| DE | 10 2008 024366 | 11/2009 |
| EP | 0 411 888 | 2/1991 |

* cited by examiner

PLUG-TYPE CONNECTOR

CROSS-REFERENCE TO RELATED APPLICATIONS

This application is a continuation of International Application No. PCT/EP2011/053753, filed Mar. 11, 2011, which claims the benefit of German Application No. 10 2010 011 371.9 filed Mar. 12, 2010, the entire disclosures of which are hereby incorporated by reference.

FIELD OF THE INVENTION

The invention relates to a plug-type connector with a contact carrier element inside of which one or more contact elements for receiving one or more conductors or wires of a cable can be arranged for producing a contacting (e.g., an electrical connection).

BACKGROUND OF THE INVENTION

Such plug-type connectors customarily comprise a contact carrier element manufactured from a non-conductive material, wherein the contact carrier element can receive, for example, multiple (e.g., three or five or more) contact elements for producing an electrically conductive connection to a cable or to the individual conductors or wires of a cable. The contact elements are customarily permanently connected to the contact carrier element so that a shifting of the contact element by forces acting externally is not possible. If the force acting from the outside becomes too great, the contact element or the connection to the contact carrier element can be destroyed. Such a large force acting from the outside can arise, for example, if the cable is constructed using massive wires or conductors that must be bent during the laying of the cable into the desired position. This can occur in particular if the cable constructed from massive conductors is already arranged in the plug-type connector or in the contact element of the plug-type connector and the cable is bent so that high forces act on the cable and therefore on the contact element or on the contact carrier element. As a result, the contacting in the plug-type connector can be interrupted in an undesired manner. During the bending of such a massive cable a shifting of the individual conductors inside the cable can occur, whereby the conductors can shift relative to each other to differing extents. In such a shifting, for example, a conductor can apply such a great force on the contact element in which the wire is arranged for the contacting that the contacting is interrupted.

SUMMARY OF THE INVENTION

The invention therefore solves the problem of making a plug-type connector available in which a reliable contacting (e.g., an electrical connection) can be ensured even upon the application of a relatively large force on the cable arranged in the plug-type connector. The solution to the problem takes place in accordance with the invention by the features of claim 1. Advantageous embodiments of the invention are indicated in the subclaims.

According to one aspect, a plug-type connector is disclosed, comprising a contact carrier element, wherein a contact element is arranged in the contact carrier element for receiving a wire or conductor of a cable, wherein the contact element is fixed in the contact carrier element, wherein upon the exertion of a force on the contact element that is greater than the holding force of the fixing, the fixing can be released and the contact element is movably mounted in the contact carrier element.

More than one contact element is preferably provided in the contact carrier element, whereby the individual conductors or wires of the cable are arranged in a contact element in the contact carrier element. The conductors or the cable are/is preferably designed as especially rigid conductors or a cable. According to one aspect of the disclosure, the contact element in the contact carrier element can have two different states. In the first state, the contact element is permanently fixed in the contact carrier element, so that it cannot be moved inside the contact carrier element. In this state, for example, the introduction of the individual conductor into the contact element preferably takes place so that during the connection of the wire to the plug-type connector no shifting of the contact element is possible, in order to be able to produce the most reliable connection possible or the most reliable coupling. In the first, fixed state the contact element is preferably arranged in a middle position along the longitudinal axis of the contact carrier element. As used herein, the term "middle position" mean that room for the movement for the contact element is free behind and in front of the contact element in the longitudinal direction of the contact carrier element so that the contact element can be shifted in the axial direction into a position to the right and to the left of the middle position. In the second state the contact element is not stationarily fixed in the contact carrier element but can be moved inside the contact carrier element. In order to transfer the contact element from the first state into the second state a force is necessary that must be applied onto the contact element that is greater than the holding force that fixes the contact element stationarily in the contact carrier element. Such a force can be applied, for example, in that the cable arranged in the plug-type connector is bent, as a result of which a shifting movement of the individual conductors of the cable is produced. If such a force acts on the contact element, which force is greater than the holding force of the fixing, the fixing is released so that the contact element is no longer arranged fixed in the contact carrier element but rather is movably mounted in the contact carrier element. In this state the contact element can be moved inside the contact carrier element in accordance with the force acting on the contact element. As a result, the longitudinal differences between the individual conductors that are produced during the bending of the cable can be compensated, which can prevent the contacting of the conductors in the plug-type connector from being interrupted and/or damaged. This makes it possible to ensure a particularly reliable contacting that can even be ensured if the cable already arranged in the plug-type connector must be bent by the application of high forces.

According to an advantageous embodiment of the disclosure, the contact element comprises a conductor connection clamp or terminal for receiving the conductor or wire and comprises a plug contact, wherein upon the exertion of force onto the contact element that is greater than the holding force of the fixing, the conductor connection clamp is movably mounted in the contact carrier element. Thus, the contact element preferably includes a conductor connection clamp and a plug contact, whereby the conductor connection clamp can be firmly connected, for example, to the plug contact. The conductor connection clamp serves to receive a conductor or wire of the cable in order to produce the contacting. If the conductor connection clamp is firmly connected, for example, to the plug contact, the conductor connection clamp as well as the plug contact are movably mounted in the contact carrier element upon a release of the fixing, whereby the conductor connection clamp and the plug contact can collectively perform a similar movement dependent on one another. If the conductor connection clamp is firmly connected to the plug contact, a floating mounting of the conductor connection clamp can be provided in the second, movably mounted state, whereby a collective movement of the conductor connection clamp and the plug contact is possible in the axial direction along the longitudinal axis of the contact element in order to be able to compensate the longitudinal differences between the individual conductors that are produced during the bending of the cable.

In a preferred embodiment, a flexible, electrically conductive connection element is provided between the conductor connection clamp and the plug contact. In such a design of the plug-type connector, preferably only the conductor connection clamp is movably mounted in the contact element, while the plug contact is arranged stationarily in the contact element in the second state. Upon the exertion of a force on the contact element that is greater than the holding force of the fixing, a movement of the conductor connection clamp relative to the plug contact therefore takes place. An electrical connection of the conductor introduced into the conductor connection clamp with the plug contact takes place via the flexible, electrically conductive connection element. It is possible in such a design that the conductor connection clamp of the contact element can compensate for an angular offset as well as an offset in height of the conductor or wire introduced into the contact element or the conductor connection clamp. This makes possible a flying mounting of the conductor connection clamp. The connection element can receive the forces upon an oblique position of the conductor or wire. This makes it possible for a constant pressure and a constant transition resistance to be realized in the contact element since the conductor connection clamp can assume the corresponding position of the conductor or wire. Thus, in such a design with a flexible, electrically conductive connection element between the conductor connection clamp and the plug contact, not only an axial longitudinal compensation is possible, but also in addition, an angular offset and/or offset in height of the conductor or wire introduced into the conductor connection clamp which offset(s) is/are produced by the longitudinal shift. The connection element is preferably arranged here firmly on the connector connection clamp by a first end and is arranged permanently on the plug contact by a second end opposite the first end, whereby the fastening on the conductor connection clamp and the plug contact can take place, for example, by welding such as, for example, resistance welding, soldering and/or riveting.

The flexible, electrically conductive connection element is preferably produced from a metallic wire constructed from an elastic material. Such a metallic wire can be, for example, a copper wire that has an especially high elasticity in order be able to compensate for extremely small shifting movements of the conductor connection clamp produced by the wire introduced in the conductor connection clamp.

The fixing of the contact element is preferably formed by at least one catch means arranged on the contact element. This catch means arranged on the contact element can hook, for example, in an opening formed on the contact carrier element in order to fix the contact element in the first state, whereby the catch means can disengage out of the opening by exerting a force on the catch means that is greater than the holding force of the fixing in the opening in order to be able to allow a shifting of the contact element relative to the contact carrier element. The catch means is preferably provided on the conductor connection clamp, whereby two catch means are preferably provided on the conductor connection clamp that are formed on opposing side surfaces of the conductor connection clamp. The catch means can be constructed, for example, as a type of projection or convexity from the side surface of the conductor connection clamp. Furthermore, it is also possible to construct the catch means in the manner of a pin or a stud. In addition to the exerting of the holding force, the catch means can additionally prevent the contact element from being able to slide out from the contact carrier element in an undesired manner.

BRIEF DESCRIPTION OF THE DRAWINGS

The disclosure is explained in detail in the following with reference made to the attached drawings using preferred embodiments.

DESCRIPTION OF PREFERRED EMBODIMENTS

Figure 1:
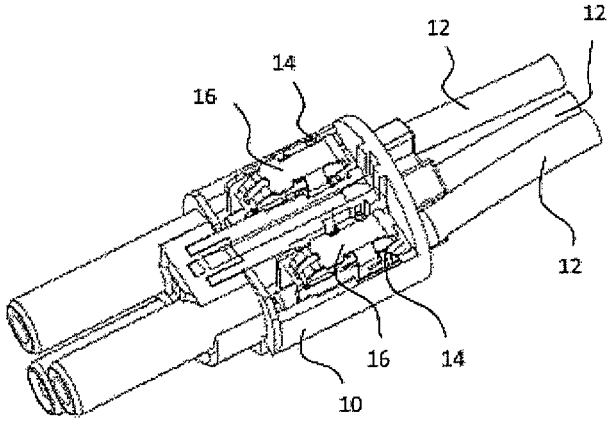
FIG. 1 shows a schematic view of a plug-type connector in accordance with the disclosure in a top view.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates. FIG. 1 shows a schematic view of a plug-type connector in accordance with the disclosure with a contact carrier element 10 produced from a non-conductive material, for example, a plastic material, inside of which element 10 several conductors 12 of a cable can be received for the contacting. In order to receive each individual conductor 12 a contact element 16 is arranged for each conductor 12 inside the contact carrier element 10.

Figure 2:
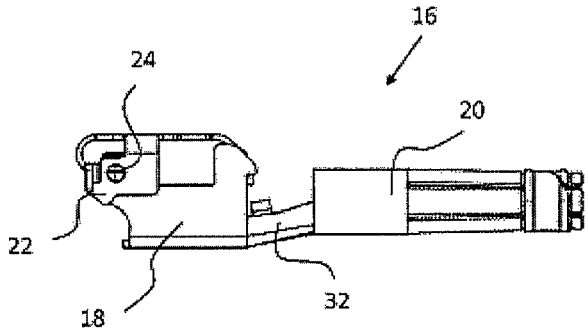
FIG. 2 shows a schematic view of a contact element in accordance with a first embodiment.

One embodiment of a contact element 16 is shown in FIG. 2. The contact element 16 has a conductor connection clamp 18 and a plug contact 20, whereby the conductor connection clamp 18 is connected in this embodiment via a rigid connection 32 to the plug contact 20. The conductor connection clamp 18 serves to receive a conductor 12 of the cable. Catch means 24 in the form of projections are formed on the side surfaces 22 of the conductor connection clamp 18 and can hook into openings 14, that are not shown here, formed on the contact carrier element 10 in order to be able to fix the contact element 16 in a first state stationarily in the contact carrier element 10. If a force is exerted on the contact element 16 that is greater than the holding force of the fixing formed by this catch means 24, the fixing can be released in that the catch means 24 can unhook from the openings and the contact element 16 is transferred from the first state into a second state, whereby in the second state a freely movable mounting of the contact element 16 is realized inside the contact carrier element 10 in order to be able to compensate, for example, for bending of the cable, which causes differences in length between the individual conductors 12, that are introduced into the plug-type connector, by an axial shifting of the contact element 16 inside the contact carrier element 10.

Figure 3:
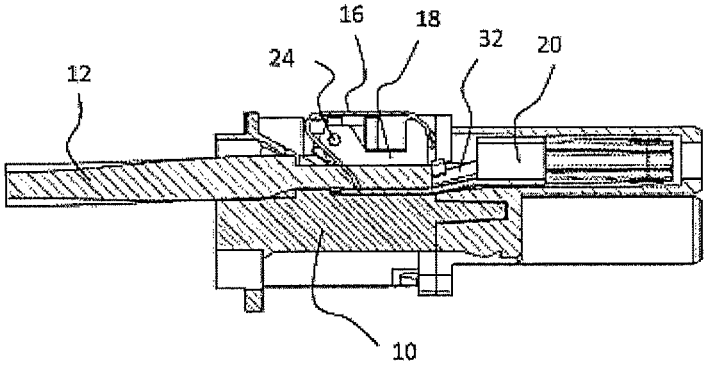
FIG. 3 shows a schematic sectional view of the plug-type connector shown in FIG. 1 with a contact element according to FIG. 2.

FIG. 3 shows a sectional view of a plug-type connector in accordance with the disclosure with the contact element 16 similar to the one shown in FIG. 2, whereby a conductor 12 is arranged in a contacting manner in the conductor connection clamp 18 of the contact element 16. A similar movement of the conductor connection clamp 18 and of the plug contact 20 takes place upon the exerting of a force greater than the holding force of the fixing on the contact element 16 by the rigid connection 32 of the conductor connection clamp 18 to the plug contact 20. In such an embodiment the conductor connection clamp 18 and/or the contact element 16 is/are preferably mounted in the contact carrier element 10 in a floating manner, whereby upon the release of the fixing a movement of the contact element 16 is possible in the axial direction along the longitudinal axis of the contact element 16 inside the contact carrier element 10.

Figure 4:
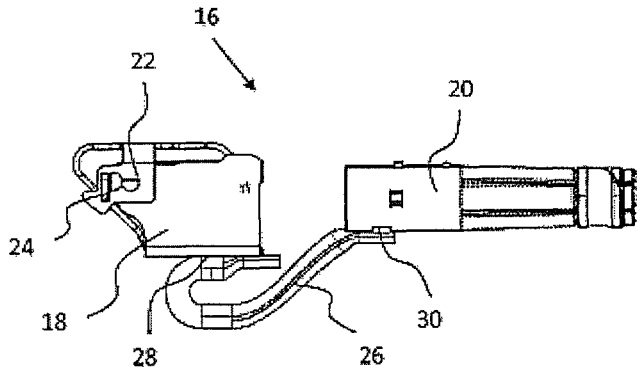
FIG. 4 shows a schematic view of a contact element in accordance with the disclosure according to a second embodiment.

FIG. 4 shows a second possible embodiment of the contact element 16, whereby the conductor connection clamp 18 is not rigidly connected to the plug contact 20 but rather the conductor connection clamp 18 is preferably connected via a flexible, electrically conductive connection element 26, for example, in the form of a metallic wire, to the plug contact 20. The plug contact 20 is preferably stationarily arranged in the contact carrier element 10, whereby upon the exerting of a force on the contact element 16 that is greater than the holding force of the fixing, a movement of the conductor connection clamp 18 relative to the plug contact 20 can take place. As a consequence, it is possible that the contact element 16 or the conductor connection clamp 18 of the contact element 16 can not only compensate for a purely axial movement of the conductors 12 (due to differences in length between the individual conductors 12 being produced), but can execute at the same time a shift in height as well as a lateral movement for compensating angular offsets.

Figure 5:
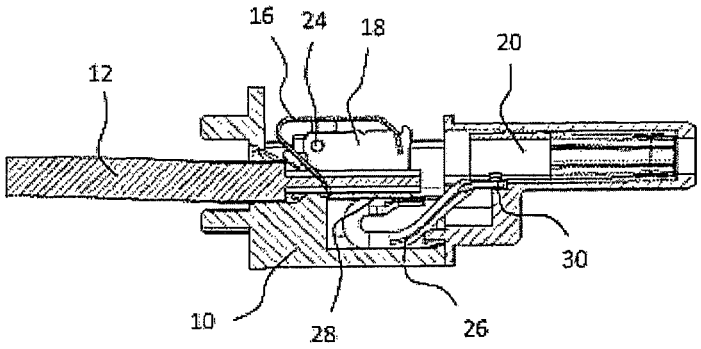
FIG. 5 shows a schematic sectional view of the plug-type connector shown in FIG. 1 with the contact element according to FIG. 4.

A contact element 16 according to FIG. 4 is shown in FIG. 5 in a contact carrier element 10, whereby a conductor 12 of a cable is arranged in the conductor connection clamp 18 of the contact element 16. The connection element 26 is connected to a first end section 28 on the conductor connection clamp 18 and to a second end section 30 opposite the first end section 28 with the plug contact 20, whereby the connection of the connection element 26 to the conductor connection clamp 18 and/or to the plug contact 20 can take place, for example, via a welding connection, a soldering connection and/or a rivet connection. The realizing of an electrical contacting of a conductor 12 introduced into the conductor connection clamp 18 to a conductor introduced into the plug contact 20, not shown here, takes place in the second embodiment of the contact element 16 shown in FIG. 4 and FIG. 5 via the flexible connection element 26 and in the first embodiment of the contact element 16 shown in FIG. 2 and FIG. 3 via the rigid connection 32 between the conductor connection clamp 18 and the plug contact 20.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

LIST OF REFERENCE NUMERALS

Contact carrier element 10
Conductor 12
Opening 14
Contact element 16
Conductor connection clamp 18
Plug contact 20
Side surface 22
Catch means 24
Connection element 26
First end section 28
Second end section 30
Rigid connection 32

The invention claimed is:

1. A plug-type connector, comprising:

a contact carrier element;

wherein a contact element for receiving a conductor of the cable is arranged in the contact carrier element, characterized in that the contact element is fixed in the contact carrier element; and wherein upon the exertion of a force on the contact element that is greater than the holding force of the fixing, the fixing is released and the contact element becomes movably mounted in the contact carrier element.

2. The plug-type connector according to claim 1, characterized in that the contact element comprises a conductor connection clamp for receiving the conductor and comprises a plug contact, wherein upon the exertion of a force on the contact element that is greater than the holding force of the fixing the conductor connection clamp becomes movably mounted in the contact carrier element.

3. The plug-type connector according to claim 2, characterized in that a flexible, electrically conductive connection element is provided between the conductor connection clamp and the plug contact.

4. The plug-type connector according to claim 3, characterized in that the flexible, electrically conductive connection element is a metallic wire constructed from an elastic material.

5. The plug-type connector according to claim 1, characterized in that the fixing of the contact element is formed by at least one catch arranged on the contact element.

* * * * *